US005838120A

United States Patent [19]

Semenkin et al.

[11] Patent Number: 5,838,120

[45] Date of Patent: Nov. 17, 1998

[54] ACCELERATOR WITH CLOSED ELECTRON DRIFT

[75] Inventors: Alexander V. Semenkin; Valerii I. Garkusha, both of Kaliningrad; Sergey O. Tverdokhlebov, Ivanteevka; Nadezhda A. Lyapina, Kaliningrad, all of Russian Federation

[73] Assignee: Central Research Institute of Machine Building, Russian Federation

[21] Appl. No.: 678,871

[22] Filed: Jul. 12, 1996

[30] Foreign Application Priority Data

Jul. 14, 1995 [RU] Russian Federation ..... 95113152

[51] Int. Cl.[6] ..... H01J 1/52; H05H 1/00

[52] U.S. Cl. ..... 315/505; 315/111.3; 315/111.31; 315/111.21; 313/231.31; 313/231.41; 313/362.1; 313/363.1; 250/396 R; 250/423 R

[58] Field of Search ..... 315/505, 500, 315/501, 111.41, 111.3, 111.31, 111.21; 313/231.31, 231.41, 362.1, 363.1, 361.1, 313; 250/396 R, 423 R

[56] References Cited

U.S. PATENT DOCUMENTS

| | | | |
|---|---|---|---|
| 2,636,990 | 4/1953 | Gow et al. | 250/41.9 |
| 3,309,873 | 3/1967 | Cann | 60/203 |
| 3,546,513 | 12/1970 | Hening et al. | 313/63 |
| 3,613,370 | 10/1971 | Knauer et al. | 60/202 |
| 3,924,134 | 12/1975 | Uman et al. | 250/423 |
| 3,955,091 | 5/1976 | Robinson et al. | 250/423 |
| 4,149,055 | 4/1979 | Seliger et al. | 250/396 R |
| 4,730,449 | 3/1988 | Cann | 60/203.1 |
| 4,862,032 | 8/1989 | Kaufman et al. | 313/359.1 |
| 5,132,597 | 7/1992 | Goebel et al. | 315/344 |
| 5,218,271 | 6/1993 | Egorov et al. | 315/111.61 |
| 5,218,771 | 6/1993 | Redford | 33/366 |
| 5,359,254 | 10/1994 | Arkhipov et al. | 313/15 |
| 5,359,258 | 10/1994 | Arkhipov et al. | 313/359.1 |
| 5,475,354 | 12/1995 | Valentian et al. | 335/296 |
| 5,509,266 | 4/1996 | Morozov et al. | 60/203.1 |

*Primary Examiner*—Ashok Patel

*Attorney, Agent, or Firm*—Gregory S. Rosenblatt; Wiggin & Dana

[57] ABSTRACT

The invention is related to a plasma technology field, in particular, to plasma accelerators, used in a space technology, in scientific researches and in industry. A technical result is that the accelerator has an increased lifetime which is achieved by reducing in wear of discharge chamber walls. An accelerator with closed electron drift includes a ring anode 1 with an anode cavity 2, a magnetic circuit 3, field coils 4 and pole tips 5 with a ring interpole gap, external 6 and internal 7 ring cathodes, a cathode-compensator 8, a power supply 9, a means forming positive gradient of magnetic field 10 which can be formed by walls of the anode 1 made of ferromagnetic material. Outlet edges of the anode 1 are provided with nozzles 11 made of nonmagnetic material; a nozzle shape coincides with shape of the magnetic field line of force which is tangential to outlet edges of the anode. The anode 1 is connected with a system supplying with gaseous active substance by means of the hole 12.

17 Claims, 3 Drawing Sheets

ACCELERATOR WITH CLOSED ELECTRON DRIFT

FIELD OF THE INVENTION

The invention is related to a plasma technology field, in particular, to plasma accelerators, and can be applied in a space technology when spacecraft propulsion systems are designed; it also provides a useful application in scientific research and in production of vacuum manufacturing units using different substance ion streams.

BACKGROUND OF THE INVENTION

Accelerators with closed electron drift are well known and in particular one of their variety is called accelerator with an anode layer (Garkusha et al., Plasma Accelerators with Anode Layer; in *Plasma Accelerators and Ion Injectors,* Moscow, 1984, pp 129–138). These accelerators include a magnetic system with a annular gap between its poles. A hollow ring anode is housed in the gap and connected with a positive terminal of the power supply source. The anode is communicated with an active gaseous substance supply system. An electric discharge is created in the gap between the poles in crossed magnetic and electric fields with closed electron drift. In the gap, active substance atoms are ionized and accelerated. Part of the accelerated ion stream arrives on walls limiting the discharge in radial direction and protecting the poles of the magnetic system from sputtering. This leads to wear of these walls due to ion bombardment and stipulates a short lifetime of such accelerators.

A stationary plasma engine is also known to include:

- dielectric discharge chamber with a ring accelerating channel in which ring anodes are installed;
- cathode-compensator (source of electrons) is located beyond the edge of the accelerating channel;
- magnetic system with a magnetomotive force source and magnetic circuit; its poles make up a annular gap, which is coaxial to the accelerating channel and located near to its outlet edge;
- devices to supply with active substance and power supply;
- additional cathode is connected electrically with the main cathode-compensator and located on the discharge chamber wall in a gap zone between the poles (USSR Inventors Certificate No. 1796777).

This engine has a higher lifetime and a better thrust-power characteristic due to decreasing a radial component of electric field at the accelerating channel outlet, and, therefore, improvement in focusing and reduced erosion of accelerating channel wall.

An accelerator with an anode layer is the closest analogue to the invention; the improvement is provided in focusing and decreasing the erosion of walls limiting the discharge in a radial direction due to decreasing the radial component of electric field (USSR Inventors Certificate No. 1715183. The known accelerator includes:

- discharge chamber is created by both a hollow ring anode with a gas distributor and ring cathodes which are coaxial;
- cathode-compensator is located beyond a discharge chamber edge;
- power source is connected with electrodes;
- magnetic system including a magnetic circuit with internal and external ring magnetic poles and a magnetomotive force source;

- at least two ring components are installed in an anode cavity along a direction of plasma acceleration; the ring components are electrically connected with the anode and separate its cavity into ring sections, each is connected with a gas distributor.

Plasma concentration is uniform, radial electric field is decreased and discharge chamber wall erosion is reduced by means of matching the rate of active substance flow through the ring sections. To reduce transverse electric fields the ring components separating the anode into sections are limited on the length in the discharge chamber by the magnetic surface of force.

The drawback of all known analogues, including the closest analogue to the invention, is that only partial reducing of discharge chamber wall erosion, which is caused by defocusing of the accelerated ion stream, is achieved. As a result, an accelerator lifetime falls lacking. All means for improvement of ion stream focusing outlined above do not eliminate entirely falling of the ion stream on the chamber walls because some defocusing is an inherent property of the ion stream in the accelerators with closed electron drift. In the known accelerators' designs, the discharge chamber walls are located along of the accelerated stream at a distance not less than the characteristic length $L_{rt}$ (rated acceleration length):

$$L_{rt} = 1/\omega_e \sqrt{2(e/m)V_p(\nu_e/\nu_i)}$$

where:

e—electron charge, m—electron mass, $V_p$—applied voltage, $\omega_e$—cyclotron electron frequency, $V_e$—electron scattering frequency, $V_i$—ionizing collision frequency.

When the part of the ion stream falls on the chamber walls, this causes their erosion and so reduces an accelerator lifetime and brings in the ion stream the impurities of sputtered substance atoms.

Experimental research had shown, that a wall wear value is practically equal to zero on an anode level, and it increases downwards from the anode along the active substance flow. It means that there is a fundamental possibility to control the wear value by changing of a discharge chamber depth: decrease of a distance between an anode and accelerator outlet edge allows to reduce the wear to any required value. However, in all known analogues the anode can be displaced on limited distance towards the accelerator outlet edge. In certain displacement of the anode towards the outlet edge, a discharge transfers into the area of magnetic field which falls downwards along the active substance flow. This brings into existence the intensive oscillations; the discharge loses stability; performance of the accelerator drops sharply; the accelerated ion flow becomes out-of-focus and causes intensive wear of the discharge chamber walls.

SUMMARY OF THE INVENTION

The objective of the invention is to make up a high-performance accelerator with closed electron drift that is free of drawbacks which are inherent in the devices are known. Both increasing of an accelerator lifetime by reducing of the discharge chamber wall wear and decreasing of ion flow contamination with the sputtered substance atoms are achieved as technical results.

The mentioned results are realized by means of the accelerator with mash electron drift which includes:

magnetic system with a ring hollow magnetic circuit which has the poles; the poles are provided with pole tips that create a ring gap between the poles; besides, there is a magnetomotive force source in the magnetic system;

hollow ring anode is located in a cavity of the magnetic circuit; the anode cavity is open towards the ring gap between the poles; outlet edges of the anode cavity are located between the pole tips; the pole tips together with the hollow ring anode create a discharge chamber which is connected with the gaseous active substance feed system;

external and internal ring cathodes are located in the gap between the poles downwards along the active substance flow;

cathode-compensator is located beyond the accelerator edge;

DC power supply source; its positive terminal is connected with the hollow ring anode; a negative terminal is connected with the cathodes.

According to the invention, the accelerator includes a means which forms a positive gradient of magnetic field beyond the outlet anode edge; the gradient is aligned with the active substance flow; the means is placed in the magnetic circuit cavity and covers, at least partially, the ring anode cavity on the side that is opposite to outlet edges of the mentioned anode. A ring anode outlet edge position is that a distance between its outlet edges and an end face of the external magnetic poles must satisfy the condition:

$$-L_1<L<L_2,$$

where: $L_1$—distance that is determining an insertion value of the hollow ring anode edge into the magnetic circuit cavity in relation to the external end face surface of the magnetic poles; $L_2$—value of the mentioned edge extension beyond the accelerator edge. In this case:

A) $L_1=L_{rt}$—is an expanse of the discharge zone along the accelerator center line. It can be expressed by the equation:

$$L_{rt} = 1/\omega_e\sqrt{2(e/m)V_p(\nu_e/\nu_i)} \quad (1)$$

where:

e—electron charge, m—electron mass, $V_p$—applied voltage, $\omega_e$—cyclotron electron frequency, $V_e$—electron scattering frequency, $V_i$—ionizing collision frequency.

B) $L_2$=H—distance between the pole tips; a positive direction of distance measurement is taken downwards along the active substance flow in relation to the external end face of the magnetic poles.

In this case, the means forming a positive gradient of magnetic field beyond the anode outlet edge along the active substance flow can be created as a ring hollow element of ferromagnetic material; the element cavity is open towards the ring gap between the poles and is located concentric to the hollow ring anode; the ring cavities of the anode and ferromagnetic element, at least partially, are overlapped; in this case, distance l between the outlet edges of the mentioned anode and ferromagnetic element is satisfied to condition $$-l_1<l<l_2$$

where: $l_1$, $l_2$—distances are determining both an insertion value of the hollow ring anode edge into the ferromagnetic element cavity and an extension value of the mentioned edges in relation to a plane of the outlet edge of the ring element;

$l_1=L_{rt}$, $l_2$=h—distance between external surfaces of the ring ferromagnetic element in a plane of its outlet edge; it may not be more than distance between the pole tips of magnetic system.

It is preferred that the means forming the positive gradient of magnetic field down the active substance flow beyond the outlet anode edge can be created by a layer of ferromagnetic material, which is applied on the ring anode hollow walls or on the external surfaces of the ring hollow anode.

It is also preferred that the means forming the positive gradient of magnetic field down the active substance flow beyond the outlet anode edge can be created by a ring hollow anode of ferromagnetic material.

Besides, it is preferred that the means forming the positive gradient of magnetic field, which is created as the ring hollow element of ferromagnetic material, can be placed inside the ring hollow anode and can be adjacent with its external walls to the hollow walls of the mentioned anode; or the means can be placed outside the ring hollow anode and be adjacent with the walls of its cavity to external surfaces of the mentioned anode.

It is also preferred that the outlet edges of the ring hollow anode are provided with nozzles of nonmagnetic material such as graphite or temperature stable metal, for instance, molybdenum, titanium, stainless steel; external surfaces of the nozzles, that are made of nonmagnetic electric conductive material, are created with curvature which coincides with curvature of magnetic field line of force that is a tangent to the anode outlet edges.

Besides, it is preferred that the ring hollow element, that is made of ferromagnetic material, is provided with at least one hole to supply the gaseous active substance into the discharge chamber, and cobalt alloy is chosen as ferromagnetic material with high Curie temperature.

It is also preferred that the external and internal ring cathodes is made of electric conductive material which is resistant to sputtering, for instance, graphite; the pole tips are conducted with a negative terminal of a direct current power source. In this case, the magnetomotive force source can be made as field coils or an permanent magnet.

The technical result that has been mentioned above can be obtained in the aggregate of essential properties by creating of conditions for reducing the discharge chamber depth, optimal placing of the anode outlet edge in relation to the accelerator outlet edge and forming the increasing magnetic field (positive gradient of magnetic field) in a zone in the vicinity of the anode downwards the active substance flow. An expanse of area with the positive gradient of magnetic field is equal to or more than an expanse of area is occupied with the discharge if design data are optimum. As a result, this allows to lift the restrictions which are inherent in a known level of technology and gives an opportunity the anode to protrude towards the outlet edge and, therefore, erosion to reduce; this eliminates discharge instability and occurrence of the out-of-focus and back ion flows which are caused by oscillations in the electric discharge; high accelerator efficiency is maintained independently of anode locating in relation to outlet edges of the accelerator discharge chamber.

DESCRIPTION OF THE FIGURES

The invention is explained by some examples which are illustrated by the drawings.

DETAILED DESCRIPTION OF THE INVENTION

Figure 1:
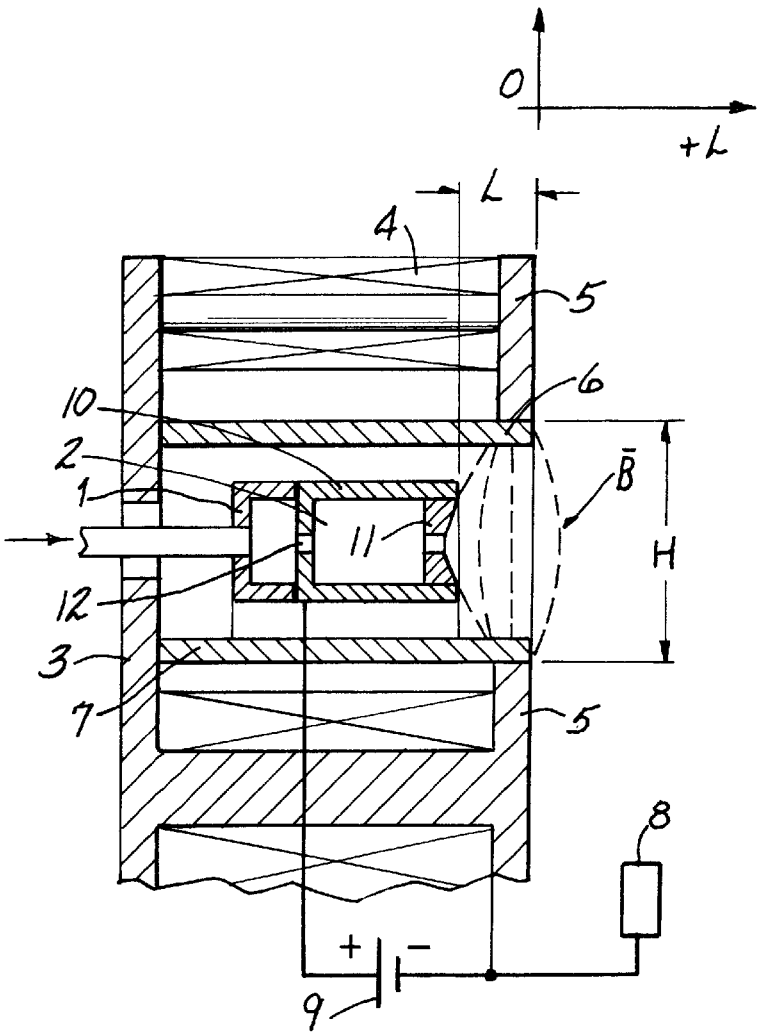
FIG. 1 is a sketch of structure of the accelerator with closed electron drift which is built according to the invention and includes the means forming the positive gradient of magnetic field beyond the outlet anode edge that is created by the ring hollow anode walls are made of ferromagnetic material.

As it is shown on FIG. 1, the accelerator with closed electron drift includes:

- ring anode 1 with an anode cavity 2;
- magnetic system with a magnetic circuit 3, field coils 4 and pole tips 5 with ring gap H between them;
- external 6 and internal 7 ring cathodes are located in the gap between poles and serve as pole shields;
- cathode-compensator (electron source) 8;
- DC power supply source 9;
- means 10 which forms a positive gradient of magnetic field; it is created by the anode walls of ferromagnetic material, for example of alloy 49 KÔ;
- outlet edges of the anode 1 is provided with nozzles 11 of nonmagnetic material (for example, of molybdenum); shape of the nozzles external surface coincides to shape of the magnetic field force line B which is a tangent to the anode edges;
- anode 1 is connected with the gaseous active substance supply system through a hole 12.

Figure 2:
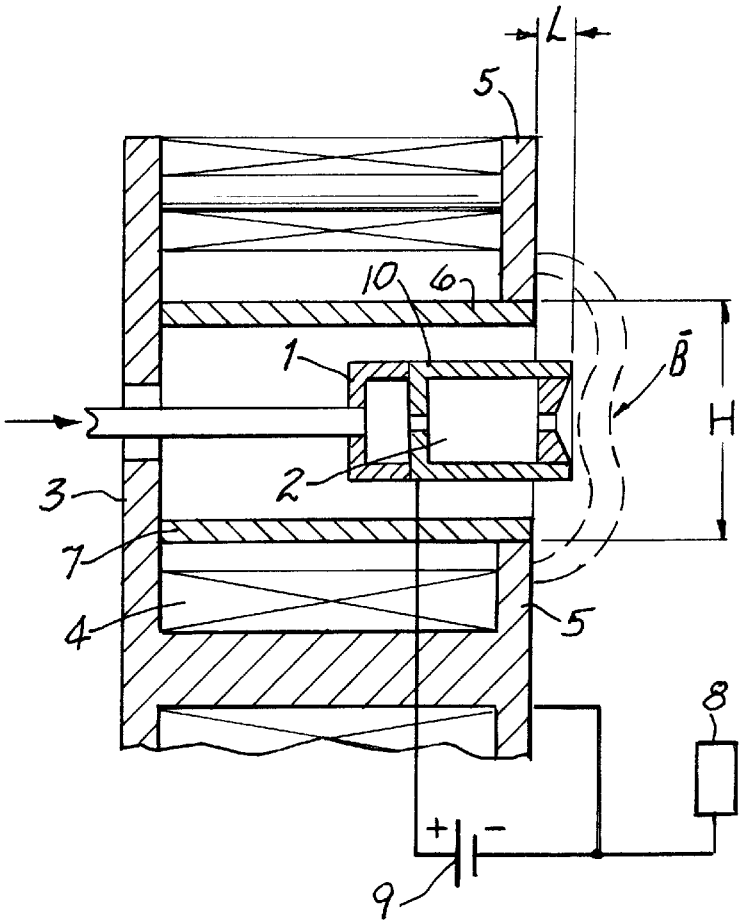
FIG. 2 shows the same that is on FIG. 1, but with different position of the ring hollow anode in relation to the accelerator edge.

A structure sketch that is shown on FIG. 2 differs from that shown on FIG. 1 in a different position of the combined ring hollow anode 1 and the means forming the positive gradient of magnetic field 10. According to FIG. 1, the anode 1 is placed deeply in the magnetic system on L depth which is limited by value $L_{rt}$ obtained from equation (1) as it is shown above. According to FIG. 2, the anode 1 is placed beyond the accelerator edge on the distance L which is limited as it is shown above by value H that is the distance between the pole tips.

Figure 3:
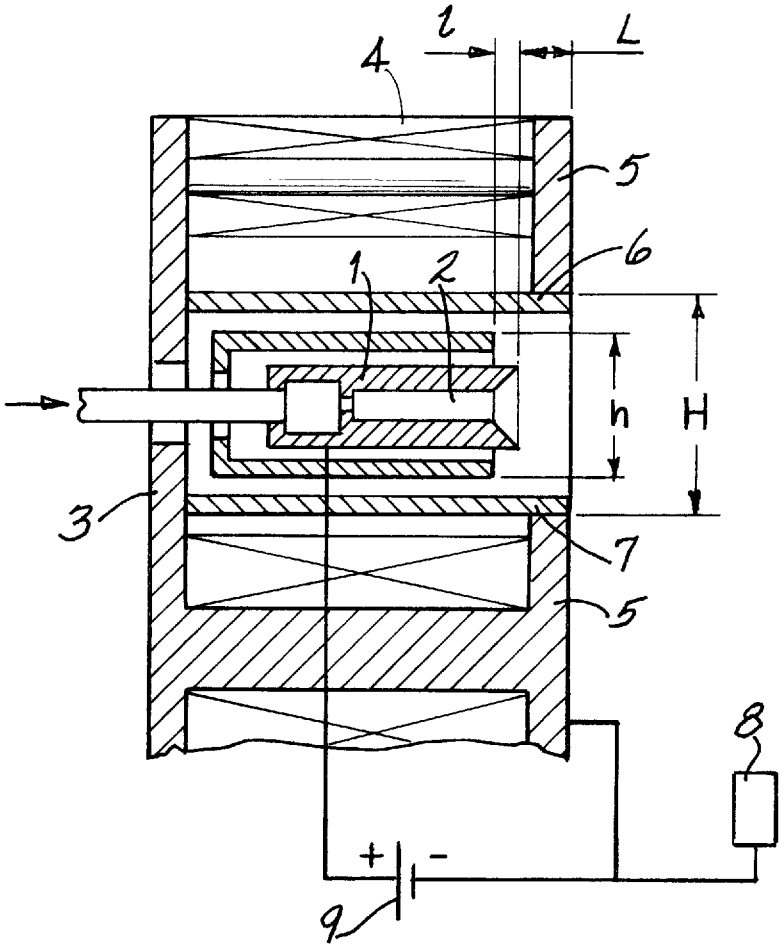
FIG. 3 is a sketch of structure of the accelerator with closed electron drift which is built according to the invention and includes the means forming the positive gradient of magnetic field that is made as the ring hollow element of ferromagnetic material.

A structure sketch that is shown on FIG. 3 differs from that shown on FIG. 1, 2 in design of the means forming the positive gradient of magnetic field beyond the outlet anode edge that is made as a ring hollow element 13 of ferromagnetic material; the element is placed outside of the ring hollow anode 1. The outlet anode edge is located so that the distance L between the anode edge and external end face of the pole tips 5 satisfies (as well as in the accelerator on FIG. 1) the condition:

$$-L_1<L<L_2$$

at the same limitations for $L_1$ and $L_2$ that are mentioned for FIG. 1, 2.

Figure 4:
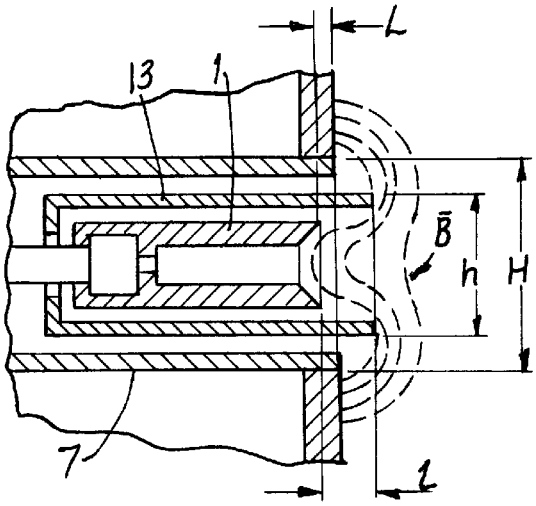
FIG. 4 shows fragments of the structure sketches of the accelerator is built according to FIG. 3 that are illustrating different mutual position of the ring hollow anode and means forming the positive gradient of magnetic field in relation to the accelerator edge.

As it is shown on FIG. 4, 5, mutual arrangement of the anode 1 and hollow element 13 is such that a distance l between the outlet anode edge and outlet edge of the element 13 satisfies the condition:

$$-l_1<l<l_2$$

where:

- value $l_1$ is limited by value of the most deep placing of the outlet anode edges on inside the hollow ferromagnetic element 13; it is equal to $L_{rt}$;
- value $l_2$ is limited by the maximum extension of outlet edges of the anode 1 beyond outlet edges of the element 13; the maximum extension is equal to distance h between external wall surfaces of the hollow element 13 in the plane of its outlet edge.

Figure 6:
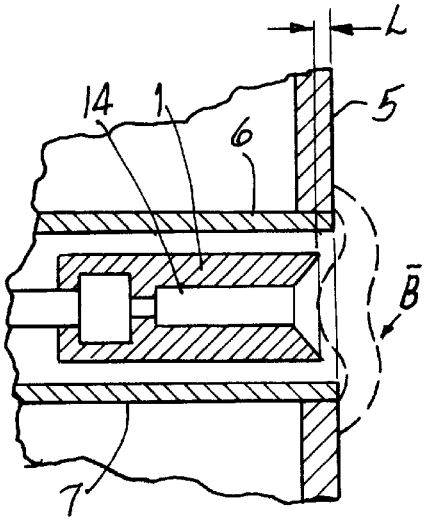
FIG. 6 shows fragments of the structure sketches of the accelerator is built according to FIG. 3 that illustrate different versions of the ring hollow element which is adjacent to the ring hollow anode on the inside or outside.
Figure 7:
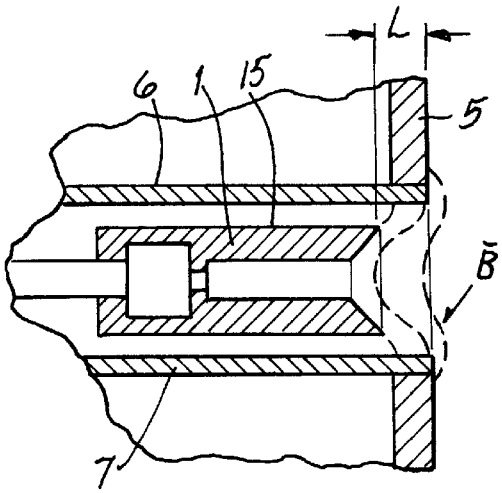
FIG. 7 shows another embodiment of the accelerator built according to FIG. 3 that illustrates different versions of the ring hollow element adjacent to the ring hollow anode on the inside or outside.

FIG. 6, 7 illustrate possible examples of design and mutual position of the means forming the positive gradient of magnetic field and the ring hollow anode. According to FIG. 6, the ring hollow element 14 of ferromagnetic material is adjacent with its external surface to walls of cavity of the anode 1; according to FIG. 7, the ring hollow element 15 of ferromagnetic material is adjacent with its cavity walls to external surfaces of the ring hollow anode 1. Similarly, it can be illustrated a design of the means forming the positive gradient of magnetic field as a layer of ferromagnetic material which is applied on cavity walls of the ring anode 1 (it accords with No. 14 on FIG. 6) or as a layer which is applied on external surfaces of the ring anode 1 (it accords with No. 15 on FIG. 7).

Since the accelerators, which are presented on the drawings as examples of their designs, operate on the same principle, the accelerator operation is considered by the example of the design that is shown on FIG. 1.

The accelerator with closed electron drift according to the invention operates as follows.

By means of the field coils 4 or permanent magnets (are not shown on drawings), magnetic field with flux density B is created in gap between the poles. The DC voltage $V_p$ that is supplied from the power source 9 takes place between the anode 1 and cathodes 6, 7, 8. Gaseous active substance, for instance xenon, is supplied from the supply system into anode cavity 2 through a hole system (for simplicity only hole 12 is shown on FIG. 1). A crossed field area is formed near the outlet anode edge; magnetic field is basically directed on radial direction, and electric field is basically directed along the accelerator axis.

Discharge with closed electron drift, in which active substance atoms are ionized and accelerated, appears in crossed fields.

An accelerated ion stream is formed at the accelerator outlet; its space charge and current are compensated by an electron stream from the cathode-compensator 8; a thermionic emission incandescent cathode or hollow cathode with supply of the gaseous active substance into its cavity can be used.

The characteristic expanse of area, in which a charge is formed and where active substance ions are accelerated, has a value:

$$L_{rt} \leqq 10\ mm$$

and can be found from equation:

$$L_{rt} = 1/\omega_e \sqrt{2(e/m)V_p(V_e/V_i)}\ ,$$

where the value:

$$e/m = 1.759 \cdot 10^{11} K \cdot C^{-1};$$

at characteristic values:

$$B = 1.5 \cdot 10^{-2} T;\ V_p = 300\ \text{V};\ \nu_e/\nu_i = 3;\ 1/Z\omega_e = (m/e)(1/B) = 0.378 \cdot 10^{-9} s$$

the expanse value is $$L_{rt} = 6.74\ mm.$$

The means forming the magnetic field positive gradient can be made as the ferromagnetic walls 10 of the anode (FIG. 1, 2) or as the ring hollow element 13 (or layers 14, 15) of ferromagnetic material (FIG. 3–7). The means shields magnetic field inside the anode cavity 2 where magnetic flux density is closed to zero, and, therefore, the area with increasing magnetic flux density, or with a positive magnetic field gradient (grad B), is formed near the outlet anode edge where the discharge is alight.

In contrast with known accelerators, positive grad B in a discharge zone is retained independently from a position of the outlet anode edges in relation to the magnetic system poles; this allows to protrude the anode towards the outlet edge for a distance L that is less than minimum distance $L_{min}$ used in the known accelerators:

$$L < L_{min} = L_{rt};$$

it is even possible to protrude the anode beyond the external end face of the magnetic system poles without a loss of the discharge stability, developing the oscillations and a loss of the accelerator efficiency.

In this case, a discharge burns either totally or partially beyond the accelerator construction. There are no walls limiting the discharge in radial direction or their length is decreased. As a result, erosion reduces essentially. This lifts the restrictions of an accelerator lifetime and provides purity of the accelerated ion stream. Therefore, the invention allows to eliminate the walls and construction elements from the accelerated ion stream zone and to use the accelerator construction without walls.

These conditions can be realized only at a definite position of the outlet anode edges in relation to the external end face of the magnetic system poles (i.e. accelerator outlet edge). According to the invention, the anode position can be varied from $L_1 = L_{rt}$ to $L_2 = H$; in this case, value $L_1$ is an allowable anode placing deep in the magnetic circuit, and $L_2$ is an allowable anode protrusion beyond the external end face of the magnetic system poles. The first limiting value is defined by the discharge area characteristic expanse $L_{rt}$. In all known accelerators an anode is placed deeply in a magnetic circuit by the value more or equal to $L_{rt}$, and decreasing of erosion in comparison to known designs is achieved only for $$-L_1 < L.$$

The second limiting value L<H is conditioned by protrusion of an anode beyond outlet edge of the magnetic system; if a protrusion distance is more than H, the anode is beyond the magnetic field area, i.e. a proper (characteristic) size such an area is approximately equal to a distance between the pole tips H [4].

Figure 5:
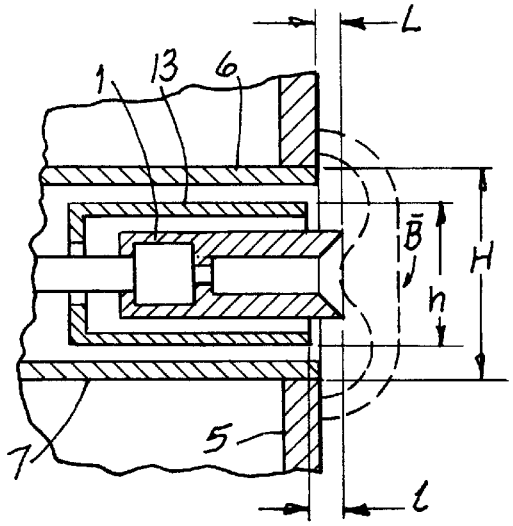
FIG. 5 shows another embodiment of the accelerator built according to FIG. 3 that illustrates different mutual positions of the ring hollow anode and means forming the positive gradient of magnetic field in relation to the accelerator edge.

In the example of the invention performance that is shown on FIG. 3–5, the ring hollow element 13 of ferromagnetic material is used; this element has a hole for gas supply. An erosion decrease, that is a technical result of the invention, is achieved only at a certain position of outlet edges of the hollow element 13 in relation to outlet edges of the hollow anode 1. For example, if outlet edges of the anode 1 are placed deeply into the ferromagnetic ring hollow element 13 more than $l_1 = L_{rt}$, walls of the mentioned element 13 are under action of a defocused part of the accelerated ion stream; as a consequence, their erosion is approximately equal to erosion of the pole shield cathodes in known accelerator designs.

Extension of an area with magnetic field, which increases downwards along a flow, is approximately equal to a distance h between external surfaces of the hollow ferromagnetic element 13 in a zone of its outlet edge; the reason is that extension of the magnetic field area, in which the hollow ferromagnetic element causes a change of field, is approximately equal to sizes of the element. Therefore, protrusion of edges of the anode 1 by a distance more than h in relation to outlet edges of the element 13 makes no sense because in this case outlet edge of the anode 1 is in the area where the ferromagnetic element 13 does not shield the magnetic field, and the necessary condition for creating a positive grad B in a discharge zone does not hold. As a result, the discharge loses stability, and efficiency decreases essentially.

A significant part of power carried by the discharge is released on the anode 1. And so, during the accelerator operation, the anode is heated up to 500–600 grad. C. The anode cavity magnetic walls 10 (FIG. 1) or the hollow element 13 (FIG. 3–5) and 14, 15 (FIG. 6, 7) are made of ferromagnetic material. To retain their magnetic properties during the accelerator operation, it make sense to use ferromagnetic alloys with high Curie temperature, for example, cobalt alloys 49 ÊÔ or 92 E.

External anode surface, which faces the discharge, has the same shape that is a magnetic line of force that is a tangent to the anode (see shape of nozzles 11 on FIG. 1, 2 or shape of the anode 1 on FIG. 3). This provides even distribution of heat flow brought on the anode by electrons, eliminates overheat and burning of sharp and protruding parts of the anode. In this case, there is an even heat flow brought to the anode 1.

If the anode is made of ferromagnetic material (FIG. 1, 2), its shape can be conformed with the shape of magnetic lines of force only when outlet anode edges are provided with nozzles of nonmagnetic material. In opposite case, magnetic lines of force will cross the surface of ferromagnetic material at an angle of 90 grad.[4]. And so, the anode 1 is provided with the nozzles 11 of nonmagnetic material which should be heat-resistant, for example, graphite, stainless steel, molybdenum or others. The nozzles 11 serve also as heat shields retarding the propagation of heat which releases on the outlet anode edges. This heat can transfer to ferromagnetic elements of construction and increase energy requirement of the accelerator.

The pole tips 5 are shielded by the external 6 and internal 7 cathodes (pole shields) of nonmagnetic material is resistant to ion sputtering, for example, graphite. The pole shields protect the magnetic system poles from sputtering and retain an optimum magnetic field distribution in the discharge zone during the accelerator operation. In this case, wear in the cathodes 6, 7 doesn't change the magnetic system elements' shape; distribution of magnetic field in the discharge zone retains at least until the cathodes are sputtered entirely and wear in the magnetic system poles begins.

The accelerator with closed electron drift, that is made according to the invention, can be applied:

in propulsion systems for correction and maintenance of orbit for long lived spacecraft, primarily for telecommunications;

in propulsion systems for interorbital transportation of spacecraft and service load;

as plasma stream source is minimum contaminated by atoms of structural materials; it can be used in production processes for surface cleaning and ion assistance at application of metal plating.

Figure 8:
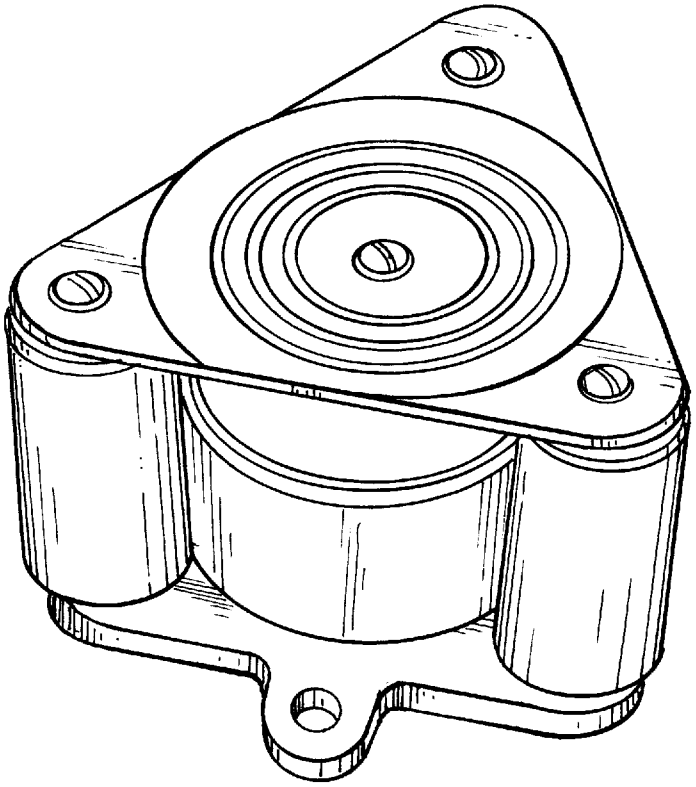
FIG. 8 is a photo of an experimental sample of the accelerator with closed electron drift is built according to the invention.

An experimental sample of the accelerator with closed electron drift (FIG. 8), which is built according to the invention, has the following characteristic data:

| | |
|---|---|
| Mass | 4 kg, |
| Size | 125 × 125 × 150 mm, |
| Operation voltage | 200–500 V, |
| Active substance | xenon, |
| Rate of active substance | 2–5 mg/s, |
| Thrust | 4–10 g (force), |
| Specific net thrust | 1000–2500 s, |
| Lifetime (on evidence from shortcut tests) | no less than 2500 h. |

SOURCES OF INFORMATION

1. V. I. Garkusha, L. V. Leskov, E. A. Lyapin. Plasma Accelerators with Anode Layer. In the book: Plasma Accelerators and Ion Injectors. Moscow, 1984, p.p.129–138.

2. Inventor's Certificate of the USSR #1796777, MÏÊ F03H1/00, H05H 1/54, 1993.

3. Inventor's Certificate of the USSR #1715183, MÏÊ H05 H1/54, Ã 03Í1/00, 1994.

4. A. G. Slivinskaya. Electromagnets and Permanent Magnets. Moscow, Energiya, 1972.

5. B. M. Yavorskiy, A. A. Detlaf. Handbook on Phisics. Moscow, Nauka, 1971.

What is claimed is:

1. An accelerator with a closed electron drift, comprising:

an annular magnetic circuit having a first magnetic pole tip and a second magnetic pole tip, said first magnetic tip and said second magnetic tip separated by a gap, said gap defining a discharge chamber;

an external ring cathode and an internal ring cathode, said external ring cathode positioned adjacent to said first magnetic tip in said gap and said internal ring cathode positioned adjacent to said second magnetic tip in said gap;

an anode positioned between said ring cathodes in said gap and comprising a first annular section having a first axis;

a second annular section adjacent to said first annular section along said first axis;

a tube mounted to said first annular section along said axis to provide gas to said discharge chamber, said tube permitting said anode to be positioned along said axis a distance L, wherein said distance L satisfies the equation $$-L_1<L<L_2,$$

where $L_1$ is a displacement with respect to an outermost edge of said external cathode ring; and represented by the equation:

$$L_1 = 1/\omega_e\sqrt{2(e/m)V_p(V_e/V_i)},$$

where:

e is electron charge;

m is electron mass;

$V_P$ is applied voltage;

$\omega_e$ is cyclotron electron frequency;

$V_e$ is electron scattering frequency;

$V_i$ is ionizing collision frequency; and $L_2$ is the distance of said gap;

an electron source in electrical communication with said magnetic circuit;

a power source in electrical communication with said magnetic circuit; and a magnetomotive force source in communication with said magnetic circuit.

2. The accelerator of claim 1, wherein said first annular section is positioned concentrically to said second annular section along said first axis, said first annular section comprising ferromagnetic material, said first annular section moveable relative to said second annular section according to the equation $$-l_1<l<l_2$$

where:

l is a distance between an outlet edge of said anode and an outlet edge of said ferromagnetic material;

$l_1$ is an outermost position on an outlet anode edge inside said ferromagnetic material and represented by the equation:

$$l_1 = 1/\omega_e\sqrt{2(e/m)V_p(v_e/v_i)}\text{ ; and}$$

$l_2$=the outer diameter of said first annular section.

3. The accelerator of claim 1, wherein said anode further comprises a layer of ferromagnetic material on the inner surface of first annular section.

4. The accelerator of claim 1, wherein said anode further comprises a layer of ferromagnetic material on the outer surface of said second annular section.

5. The accelerator of claim 1, wherein said anode comprises ferromagnetic material.

6. The accelerator of claim 2, wherein said first annular section comprising ferromagnetic material is positioned concentrically around said second annular section along said first axis.

7. The accelerator of claim 2, wherein said first second annular section is positioned concentrically around said first annular section comprising ferromagnetic material around said first axis.

8. The accelerator of claim 1, wherein said anode further comprises a nozzle comprising nonmagnetic electric conductive material.

9. The accelerator of claim 8, wherein said nonmagnetic electric conductive material is graphite.

10. The accelerator of claim 8, wherein said nonmagnetic electric conductive material is selected from the group consisting of molybdenum, titanium and stainless steel.

11. The accelerator of claim 8, wherein said nozzle includes a curved surface.

12. The accelerator of claim 2, wherein said gas flows into said discharge chamber through at least one aperture in said anode.

13. The accelerator of claim 2, wherein said ferromagnetic material is cobalt alloy.

14. The accelerator of claim 1, wherein said pole tips are in electrical communication with the negative terminal of said power source.

15. The accelerator of claim 1, wherein said external ring cathode and said internal ring cathode comprise graphite.

16. The accelerator of claim 1, wherein said magnetomotive force source comprises field coils.

17. The accelerator of claim 1, wherein said magnetomotive force source comprises a permanent magnet.

* * * * *